United States Patent [19]

Hamilton

[11] 4,396,216

[45] Aug. 2, 1983

[54] LINK ENGAGING PIPE ELEVATOR

[75] Inventor: William R. Hamilton, Houston, Tex.

[73] Assignee: Hughes Tool Company, Houston, Tex.

[21] Appl. No.: 413,044

[22] Filed: Aug. 30, 1982

Related U.S. Application Data

[63] Continuation of Ser. No. 188,204, Sep. 18, 1980, abandoned.

[51] Int. Cl.[3] ..... B66C 1/42

[52] U.S. Cl. ..... 294/90; 175/85

[58] Field of Search ..... 294/90, 91, 102 A, 113; 24/249 DP, 263 D, 263; 166/77.5, 85; 175/85, 195, 202

[56] References Cited

U.S. PATENT DOCUMENTS

| | | | |
|---|---|---|---|
| 1,834,429 | 12/1931 | Smith | 294/90 |
| 1,917,669 | 7/1933 | Smith | 294/90 |
| 2,215,649 | 9/1940 | Mullinix | 294/90 |
| 3,063,509 | 11/1962 | Guiel | 175/200 |
| 3,358,341 | 12/1967 | Burstall | 24/263 |

*Primary Examiner*—James B. Marbert

*Attorney, Agent, or Firm*—Robert A. Felsman; Charles D. Gunter, Jr.

[57] ABSTRACT

A link engaging pipe elevator is shown having link engaging arms and an automatic locking mechanism. Spring tension in the locking mechanism is overcome when the elevator body is rested on a substantially flat surface allowing unrestrained movement of the link engaging arms. As the elevator is lifted off the flat surface, the locking mechanism is activated and the link engaging arms are locked into place. A cam and cam roller assist in moving the link engaging arms between the full open and closed positions.

4 Claims, 4 Drawing Figures

LINK ENGAGING PIPE ELEVATOR

This is a continuation of application Ser. No. 188,204, filed Sept. 18, 1980, now abandoned.

BACKGROUND OF THE INVENTION

This invention relates generally to rotary earth drilling equipment of the type used to drill oil and gas wells and more particularly to an improved pipe elevator used to lift stands of pipe into and out of the well bore at substantial depths below the earth's surface.

At well depths up to about 15000 feet, the pipe string is commonly run into and out of the well bore by using a pipe elevator and slip combination. When running into the well bore, the pipe string is lowered by a single elevator and supported at the rotary table by gripping the pipe with slips that wedge in a slip bowl in a master bushing which in turn seats within the rotary table. The slips contain dies having sharp teeth which bite into the pipe. Once the slips are engaged, the elevator is released and hoisted up the derrick for connection to the next stand of pipe to be lowered. The elevator then supports the next stand of pipe while the pipe's lower end is connected to the pipe string in the well bore. After the ends are connected, the slips are released and the pipe string is again lowered into the well bore until the new pipe section is in position to be gripped by the slips. These operations are repeated until the desired length of pipe has been lowered into the well bore.

The operations are reversed to raise pipe from the well bore. The elevator is connected to the end of the drill string which protrudes from the bore and the pipe string is hoisted up the derrick. After raising a stand of pipe, the slips are set at the rotary table and the stand is uncoupled and carried by the elevator to the racking position. The elevator is then released and lowered to the rotary table to engage the protruding end of the following stand of pipe.

Although the above procedure is adequate for shallow depths, as the bore deepens the weight of the pipe string increases and places greater force on the dies in the rotary slips. The increased load causes the slips to striate or score the pipe which can result in costly damage. At times, migrating cracks caused by die scoring have brought about failure and parting of the pipe string.

To solve the problem of pipe striation, drillers have come to employ two conventional pipe elevators which are alternatively operated to support the string from the rotary table and handle the stand that is to be removed from or added to the drill string. The use of duel elevators, however, has required manual shifting of the elevators resulting in slower operating time and greater risk of injury to operating personnel. The problem was aggrevated by previous elevators which utilize pivoting arms secured by bolts for receiving and engaging the steel links which connect the elevator to the hook and traveling block. In order to remove the connecting links, the operator was required to manually fasten, unfasten and pivot the link arms.

One previously proposed elevator had spring operated link arms which cooperated with a specially designed track in the rotary table to automatically engage and disengage the steel links. In addition to requiring a modified rotary set up, this design had a link opening that overly restricted movement of the links resulting in binding between the links and the elevator body under certain conditions. The design also restricted the size of the return spring used to return the arms to the locked position and thereby increased the frequency of failure of the unit.

SUMMARY OF THE INVENTION

The improved link engaging pipe elevator of the present invention has a body with an annular opening for receiving pipe and a pair of curved shoulders which extend from the upper portion of the body. The shoulders curve inward to form a concave recess with the body for receiving the links.

Link housings extend from either side of the lower portion of the body. A shaft is mounted in each housing transverse to the housing's longitudinal axis. A link engaging arm connects to each shaft and is pivotable between a closed position to engage the links and an open position to release the links.

A cam element is connected to each of the shafts and cooperates with a cam roller mounted in each housing to urge the link engaging arms between the full closed and open positions. A spring loaded latch in each housing is biased in a locked position to engage the arms in the closed position when pipe is being lifted in or out of the well bore. The latch has a lower end which normally protrudes below the bottom surface of the elevator body. When the elevator body is rested on a substantially horizontal surface the protruding end of the latch is depressed, thereby overcoming the spring tension and unlocking the link engaging arms. The links can then be pulled free of the elevator body.

DETAILED DESCRIPTION OF THE INVENTION

Figure 1:
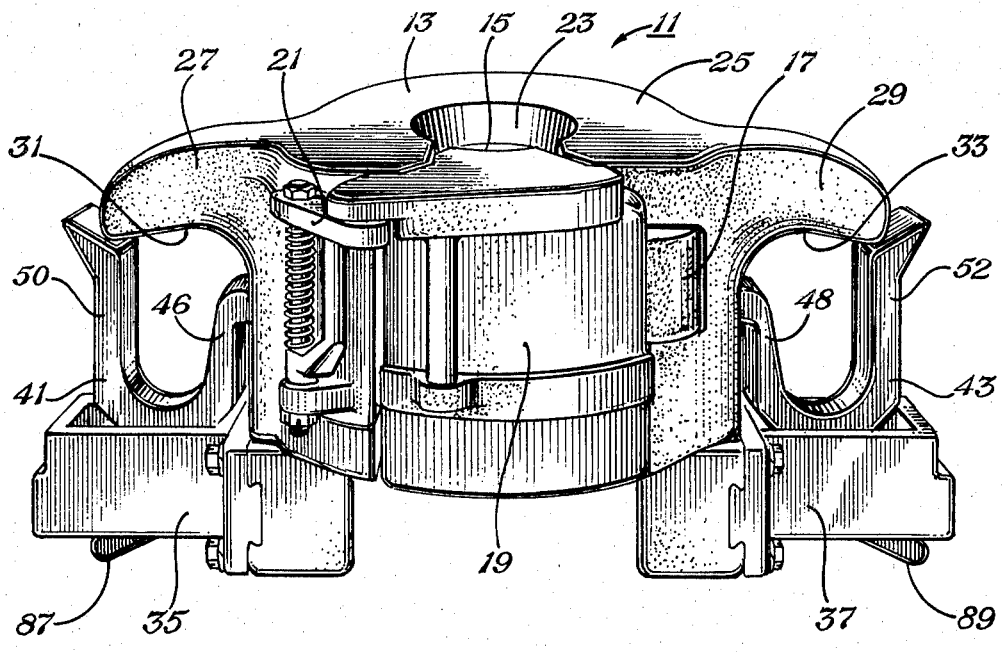
FIG. 1 is a front perspective view of the link engaging pipe elevator of the present invention.
Figure 2:
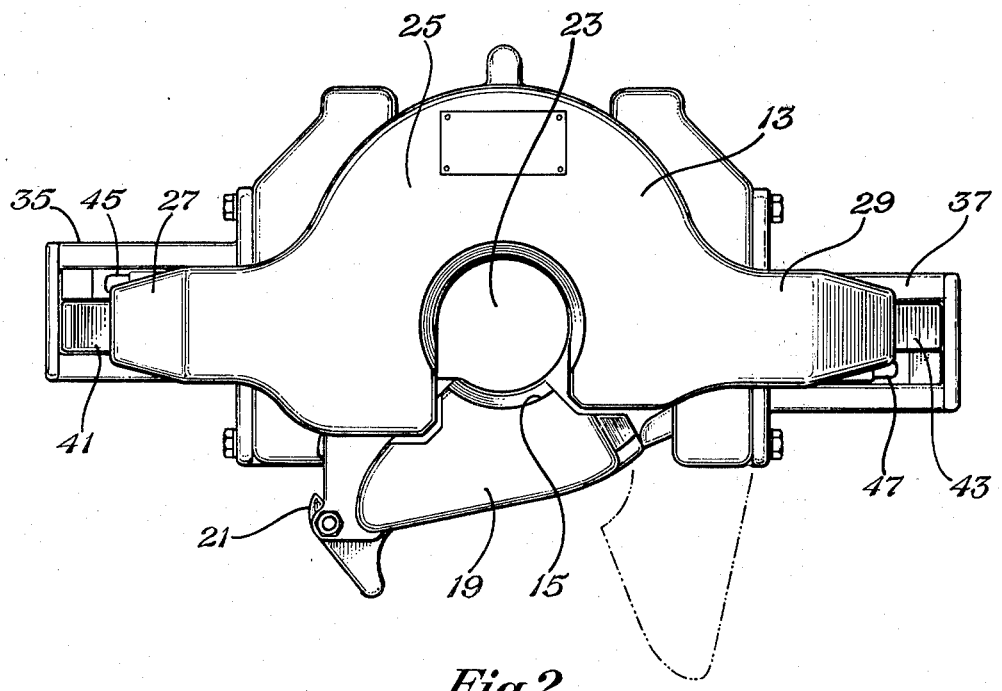
FIG. 2 is a top view of the pipe elevator.

Referring now to FIG. 1, there is shown an improved link engaging pipe elevator designated generally as 11. Elevator 11 has a semicircular body part 13 adapted to engage one side of a drill pipe and an opposite side provided with an opening 15. Pivotally connected to body part 13 at one side of opening 15 by means of a hinge 17 is a gate 19. Gate 19 is adapted to be secured to body part 13 at the opposite side of opening 15 by a latch mechanism 21. When gate 19 is closed and latched as in FIG. 2, a collar-shaped configuration having an annular opening 23 therein results. The internal diameter of annular opening 23 is selected to allow the sidewalls of a drill pipe to slide within the opening but to retain the drill pipe shoulder on upper surface 25 of body part 13.

A pair of curved shoulders 27, 29 extend outwardly from the upper portion of body part 13. Shoulders 27, 29 are curved inward toward body part 13 to form a concave recess 31, 33 on either side for receiving the eyelet portion of the steel links carried by the derrick hook and traveling block (not shown).

A link engaging mechanism including a pair of link housings 35, 37 extends from the lower portion of body part 13 in approximate vertical alignment with shoulders 27, 29. The link housings 35, 37 are spaced apart from shoulders 27, 29 to allow access to concave recesses 31, 33.

Figure 3:
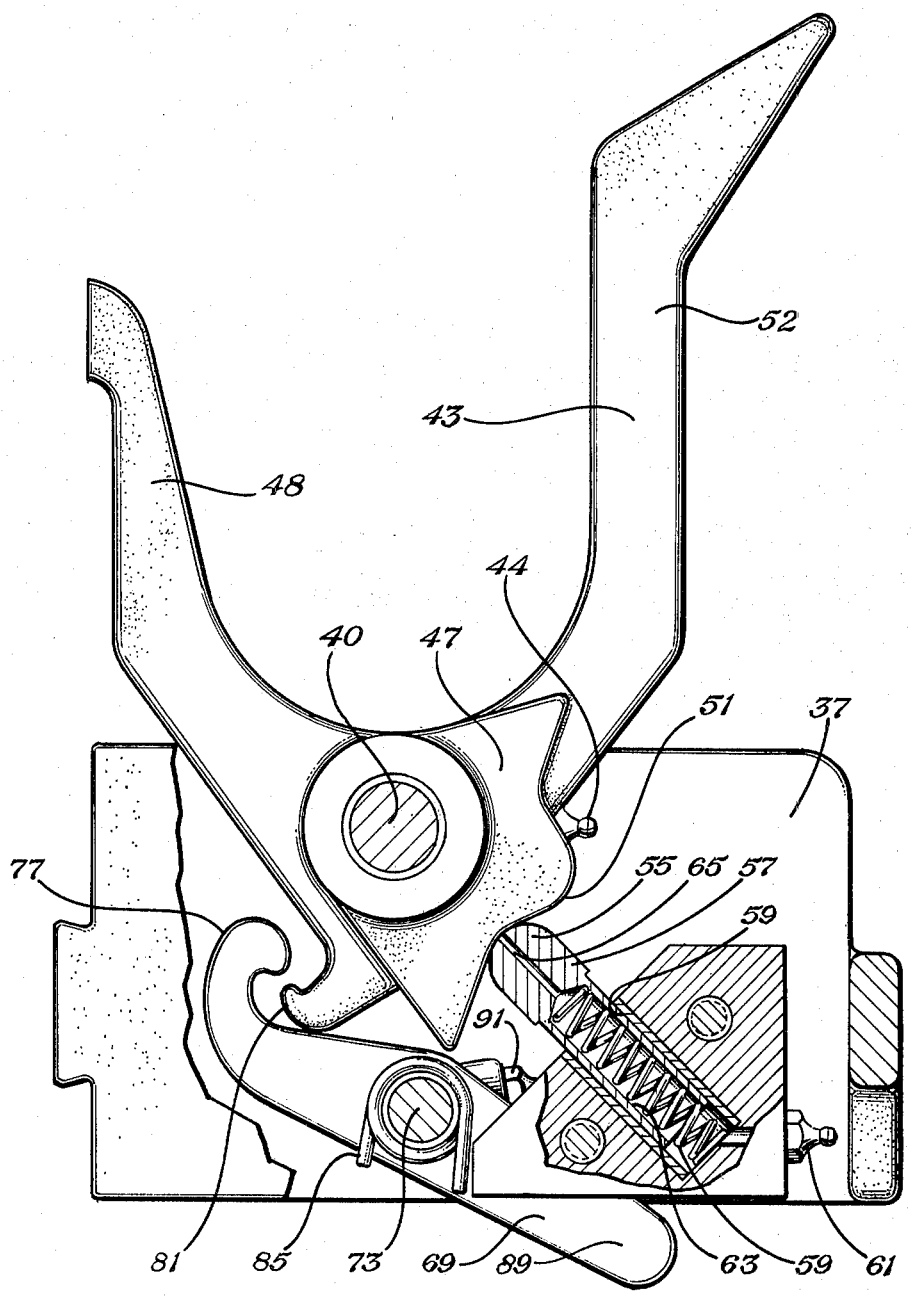
FIG. 3 is a side view of the link engaging mechanism of the invention partially broken away and partially in section to better illustrate the operation.
Figure 4:
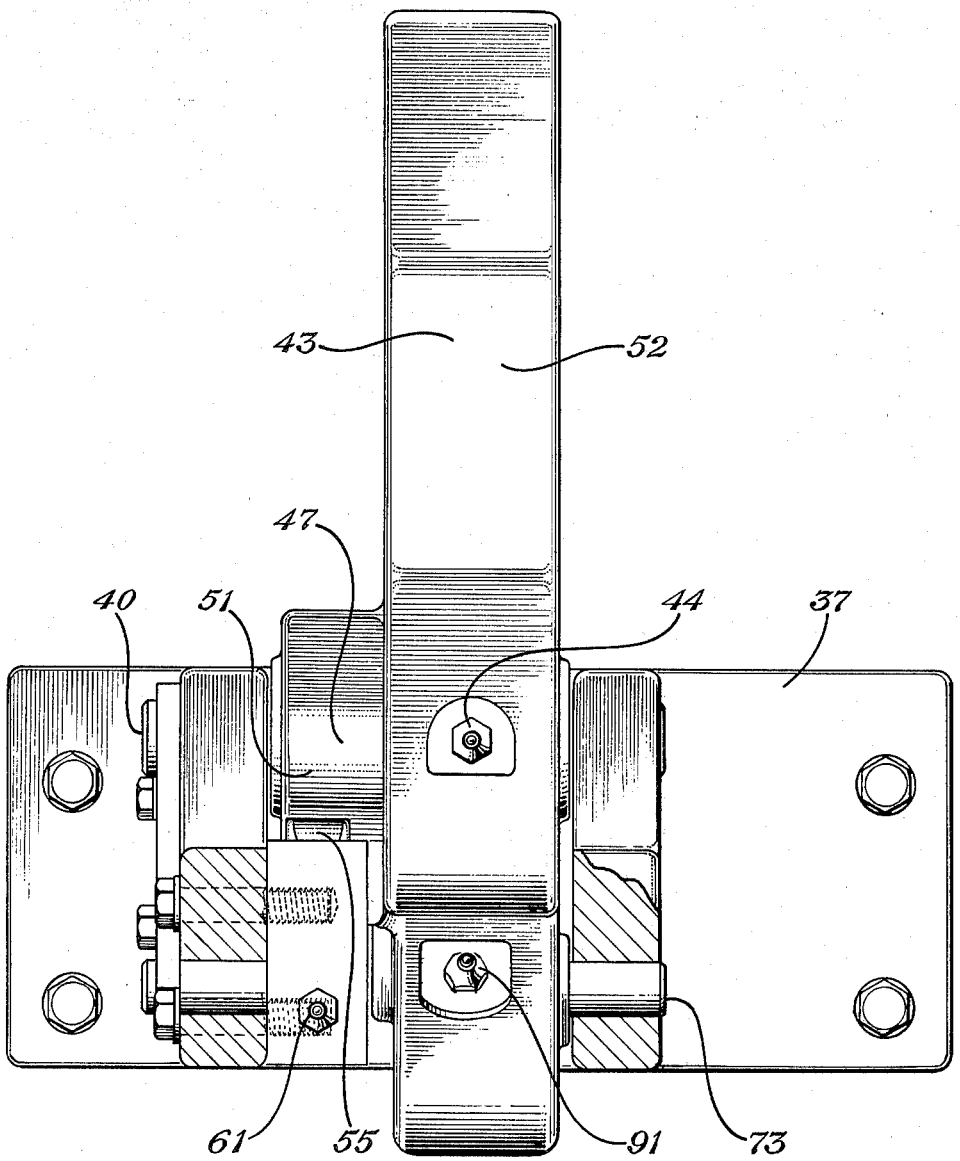
FIG. 4 is an end view of the link engaging mechanism partially broken away and partially in section.

As shown in FIG. 3, shafts 39, 40 are pivotally mounted in each of the housings 35, 37 transverse to the longitudinal axis of the housings. On each shaft 39, 40 is connected a "U" shaped link engaging arm 41, 43 having an inner flange 46, 48 and an outer flange 50, 52. Arms 41, 43 are pivotable between a closed position for engaging links and an open position for releasing links. Shaft 39, 40 are lubricated by means of grease fittings 44, it being understood that the shafts can be fitted with bushings requiring no external lubrication as well.

A pivoting means is provided to assist in moving the link engaging arms 41, 43 between the full open and closed positions. The pivoting means includes a cam element 45, 47 and cam roller 53, 55. Cam elements 45, 47 having cam surfaces 49, 51 are connected to shafts 39, 40 and are also rigidly affixed to arms 41, 43. Cam rollers 53, 55 are mounted in each of housings 35, 37 and cooperate with the cam surface 49, 51 of elements 45, 47 to urge the arms 41, 43 to the full open and closed position.

Cam rollers 53, 55 include a hollow bullet-shaped plunger 57 telescopically mounted within a cylindrical opening 59 in housing 37. A helical coil spring 59 is seated at one end against the bottom of cylindrical opening 59 and at the other end against the upper interior of plunger 57, thereby biasing plunger 57 upward into contact with cam surface 51. The cam surface 51 is lubricated by means of grease fitting 61, plunger interior 63 and port 65 in the nose region of plunger 57.

Locking means comprising spring-loaded latches 67, 69 are mounted in housings 35, 37 and are movable between a locked position to engage arms 41, 43 and an unlocked position to release arms 41, 43. Latches 67, 69 are attached to transverse shafts 71, 73 for pivotal movement within housings 35, 37 and include curved ends 75, 77 suitably positioned to engage lips 79, 81 on the lower portion of arms 41, 43. Latches 67, 69 are spring biased to a locked position for engaging arms 41, 43 by tension springs 83, 85. A grease fitting 91 is provided to allow lubrication of shaft 73.

Operation of the improved link engaging pipe elevators can best be understood with reference first to FIG. 3. Assume the link engaging mechanism is in the position shown in FIG. 3 immediately prior to setting the elevator down on the rotary table. In FIG. 3, link engaging arm 43 is limited in movement from the locked position due to the curved end 77 of latch 69 engaging lip 81 of arm 43.

End 89 of latch 69 opposite curved end 77 is normally exposed beyond the bottom surfaces of housings 37. When elevator 11 is rested on a substantially flat surfacec the tension in spring 85 is overcome and end 89 is pivoted in a counterclockwise direction about shaft 73 thereby passing upward into the interior of housing 37. Since latch 69 pivots about shaft 73, curved end portion 77 shown in FIG. 3 is caused to move in a counterclockwise manner out of engagement with lip 81 on link engaging arm 43. Movement of the link engaging arm 43 is now unrestrained and the link eyelet contained by shoulder 29 in recess 33 can now be pulled free of the elevator body. Cam roller 55 cooperates with cam surface 51 to assist in moving arm 43 to the full open position.

The previously described procedure is carried out in reverse to reengage the links. The eyelet portion of a link is passed through the space between the outer flange 52 of arm 43 and curved shoulder 29. Movement of the link eyelet into recess 33 forces inner flange 48 in the direction of the elevator body. Lip 81 is now in position to be engaged by the curved end 77 of latch 69. When the elevator is raised from the rotary table, tension in spring 75 returns latch 77 to the locked position.

It should now be apparent that an invention has been provided with significant advantages. The improved link engaging pipe elevator unlocks automatically to allow the links to be pulled free when the elevator is placed on any substantially flat surface. Lifting the elevator actuates the locking means to secure the link engaging arms in the closed and locked position. There is no need for special tracks or a modified rotary table. The "U" shaped design of the locking arms permits easy access to the recesses in the elevator body and lessens the chance of binding between the elevator body and the link. A pivoting means assists in moving the link engaging arms between the full open and closed positions to further lessen the chance of binding.

While the invention has been shown in only one of its forms, it should be apparent to those skilled in the art that it is not so limited but is susceptible to various changes and modifications without departing from the spirit thereof.

I claim:

1. A link engaging pipe elevator of the type having an elevator body with an annular opening therethrough adapted to receive pipe and a pair of curved shoulders extending from the upper portion of said body, said shoulders being curved inward to form a concave recess with respect to said body for receiving links, wherein the improvement comprises:

a pair of link housings extending from the lower portion of said body;

link engaging arms pivotally mounted in said housings, said arms being pivotable between a closed position for engaging said links and an open position for releasing said links; and locking means mounted in said housings automatically movable between an unlocked position wherein movement of said link engaging arms opens said arms when said body is rested on a substantially horizontal surface and a locked position when said body is lifted off said surface.

2. A link engaging pipe elevator of the type having an elevator body with an annular opening therethrough adapted to receive pipe and a pair of curved shoulders extending from the upper portion of said body, said shoulders being curved inward to form a concave recess with respect to said body for receiving said links, wherein the improvement comprises:

a pair of link housings extending from the lower portion of said body in vertical alignment with said shoulders but spaced apart therefrom;

link engaging arms pivotally mounted in said housings said arms being pivotable between a closed position for engaging said links and an open position for releasing said links;

pivoting means for assisting the movement of said link engaging arms between said closed and open positions; and locking means mounted in said housings automatically movable between an unlocked position wherein movement of said link engaging arms opens said arms when said body is rested on a substantially horizontal surface and a locked position when said body is lifted off said surface.

3. A link engaging pipe elevator of the type having an elevator body with an annular opening therethrough adapted to receive pipe and a pair of curved shoulders extending from the upper portion of said body, said shoulders being curved inward to form a concave recess with respect to said body for receiving said links, wherein the improvements comprises:

a pair of link housings extending from the lower portion of said body in vertical alignment with said shoulders but spaced apart therefrom;

a shaft pivotally mounted in each of said housings transverse to the longitudinal axis of said housings;

a link engaging arm connected to each of said shafts, said arms being pivotable between a closed position for engaging said links and an open position for releasing said links;

a cam element having a cam surface connected to each of said shafts;

a cam roller mounted in each of said housings and cooperating with said cam surface on said cam element to move said link engaging arms between said closed and open positions; and a spring loaded latch mounted on each of said housings automatically movable between a locked position to engage said arms and an unlocked position wherein movement of said link engaging arms opens said arms.

4. A link engaging pipe elevator for raising stands of pipe of the type having an elevator body with an annular opening therethrough adapted to receive pipe and a pair of curved shoulders extending from the upper portion of said body, said shoulders being curved inward to form a concave recess with respect to said body for receiving said links, wherein the improvement comprises:

a pair of link housings extending from the lower portion of said body in vertical alignment with said shoulders but spaced apart therefrom;

a shaft pivotally mounted in each of said housings transverse to the longitudinal axis of said housings;

a "U" shaped link engaging arm connected to each of said shafts, said arms being pivotable between a closed position for engaging said links and an open position for releasing said links;

a cam element connected to each of said shafts having a cam surface;

a cam roller mounted in each of said housings and cooperating with said cam surface on said cam element to urge said link engaging arms between their respective full open and closed positions; and a spring loaded latch mounted in each of said housings, said latches being spring biased to a locked position for securely engaging said arms as pipe is being raised by said elevator and being automatically movable to an unlocked position wherein movement of said link engaging arms opens said arms when said body is rested on a substantially horizontal surface.

* * * * *